US008390516B2

(12) United States Patent
Parsche

(10) Patent No.: US 8,390,516 B2
(45) Date of Patent: Mar. 5, 2013

(54) PLANAR COMMUNICATIONS ANTENNA HAVING AN EPICYCLIC STRUCTURE AND ISOTROPIC RADIATION, AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 432 days.

(21) Appl. No.: 12/623,870

(22) Filed: Nov. 23, 2009

(65) Prior Publication Data

US 2011/0121822 A1 May 26, 2011

(51) Int. Cl.
*H01Q 1/38* (2006.01)
*H01Q 7/08* (2006.01)

(52) U.S. Cl. ..... 343/700 MS; 343/788

(58) Field of Classification Search ..... 343/732, 343/741, 742, 743, 866, 867, 868
See application file for complete search history.

(56) References Cited

U.S. PATENT DOCUMENTS

| | | | | |
|---|---|---|---|---|
| 4,433,336 | A * | 2/1984 | Carr | 343/728 |
| 6,501,427 | B1 | 12/2002 | Lilly et al. | 343/700 |
| 6,992,630 | B2 * | 1/2006 | Parsche | 343/700 MS |
| 7,126,538 | B2 | 10/2006 | Sampo | 343/700 |
| 7,495,627 | B2 | 2/2009 | Parsche | 343/800 |
| 7,603,144 | B2 * | 10/2009 | Jenson et al. | 455/573 |
| 2005/0088342 | A1 | 4/2005 | Parsche | 343/700 |
| 2008/0211722 | A1 * | 9/2008 | Sanz et al. | 343/702 |
| 2009/0121944 | A1 | 5/2009 | Sotoudeh | 343/702 |

FOREIGN PATENT DOCUMENTS

| | | |
|---|---|---|
| GB | 2384367 | 7/2003 |
| WO | 2005/081808 | 9/2005 |

* cited by examiner

*Primary Examiner* — Douglas W Owens
*Assistant Examiner* — Collin Dawkins
(74) *Attorney, Agent, or Firm* — Allen, Dyer, Doppelt, Milbrath & Gilchrist, P.A.

(57) ABSTRACT

The antenna device includes an electrical conductor extending on a substrate and having at least one gap therein, and with an outer ring portion to define a radiating antenna element, and at least one inner ring portion to define a feed coupler and connected in series with the outer ring portion and extending within the outer ring portion. A coupling feed element is adjacent the at least one inner ring portion, and a feed structure is connected to the coupling feed element to feed the outer ring portion.

22 Claims, 9 Drawing Sheets

PLANAR COMMUNICATIONS ANTENNA HAVING AN EPICYCLIC STRUCTURE AND ISOTROPIC RADIATION, AND ASSOCIATED METHODS

FIELD OF THE INVENTION

The present invention relates to the field of wireless communications, and, more particularly, to antennas and related methods.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. It becomes increasingly important in communication applications to reduce not only antenna size, but also to design and manufacture a scalable size antenna having sufficient gain.

In current, everyday communications devices, many different types of patch antennas, loaded whips, copper springs (coils and pancakes) and dipoles are used in a variety of different ways. These antennas, however, are sometimes large and impractical for a specific application. Antennas having diverging electric currents may be called dipoles, those having curling electric currents may be loops, and dipole-loop hybrids may comprise the helix and spiral. While dipole antennas can be thin linear or "1 dimensional" in shape, loop antennas are at least 2 dimensional. Loop antennas can be a good fit for planar requirements.

Antennas can of course assume many geometric shapes. The Euclidian geometries are sometimes preferential for antennas as they convey optimizations known through the ages. For instance, line shaped dipoles may have the shortest distance between two points, and circular loop antennas may have the most enclosed area for the least circumference. So, both line and circle shapes may minimize antenna conductor length. Yet simple Euclidian antennas may not meet all needs, such as operation at small physical size relative wavelength and a self loading antenna structure may be needed. Cyclic curves may be advantaged for antennas and antenna arrays, yet cyclic antennas do not seem common in the prior art.

Simple flat or patch antennas can be manufactured at low costs and have been developed as antennas for the mobile communication field. The flat antenna or thin antenna is configured, for example, by disposing a patch conductor cut to a predetermined size over a grounded conductive plate through a dielectric material. This structure allows a nearly planar dipole antenna to be fabricated in a relatively simple structure. Such an antenna can be easily mounted to appliances, such as a printed circuit board (PCB).

Many applications, such as land mobile, may require thin planar antennas with vertical polarization when mounted in a horizontal plane. Such antennas can be planar monopoles, sometimes known as microstrip "patch" antennas. The advantages of these antennas including printed circuit manufacture, being mountable in low profile, and having high gain and efficiency have made them the antennas of choice in many applications. However, microstrip patch antennas typically are efficient only in a narrow frequency band. They are poorly shaped for wave expansion, such that microstrip antenna bandwidth is proportional to antenna thickness. Bandwidth can even approach zero with vanishing thickness (for example, see Munson, page 7-8 "Antenna Engineering Handbook", 2nd ed., H. Jasik ed.). With a thin planar shape, the loop antenna may give more bandwidth for area than the microstrip patch.

The radiation pattern shapes of many small antennas are toroidal or a $\cos^2 \theta$ rose, similar to half wave dipoles. An isotropic radiation pattern is one that is spherical in shape, however, and it may be advantageous when antennas are not aimed or oriented. Small antennas of planar construction, having sufficiently isotropic radiation may be of considerable utility.

Body worn antennas may operate near human flesh which may have a relative permittivity of about 50 farads/meter and a conductivity of 1 mho/meter, which is somewhat akin to the properties of seawater. The flesh is lossy to electric currents I if an uninsulated antenna contacts skin, lossy to electric near fields E by dielectric heating, and lossy to magnetic near fields H by induction of eddy currents. In the design of body worn antennas it can be important to take these effects into account, as for instance dielectric heating is more pronounced at higher frequencies, induction of eddy currents more important at lower frequencies, and insulation may avoid conducted current losses.

Antenna frequency stability is another concern as drifted tuning may cause gain reduction. Few small antennas are unaffected by close proximity to the human body. Antennas transducing only one type of near field (E or H) might be advantageous, but they appear to be unknown.

Shielded body worn antennas may use a metal layer between the antenna and the body to reduce losses. Although the shield reduces body affects the shield itself has effects. The conductive shield must be of sufficient size and it may reduce efficiency and bandwidth: shield reflections can be akin to the image reversal of a mirror, e.g. 180 degrees out of phase causing signal cancellation. It may be preferential to avoid shields and ground planes in body worn antennas if possible.

U.S. Pat. No. 6,501,427 to Lilly et al. entitled "Tunable Patch Antenna" is directed to a patch antenna including a segmented patch and reed like MEMS switches on a substrate. Segments of the structure can be switched to reconfigure the antenna, providing a broad tunable bandwidth. Instantaneous bandwidth may be unaffected however.

U.S. Pat. No. 7,126,538 to Sampo entitled "Microstrip antenna" is directed to a microstrip antenna with a dielectric member disposed on a grounded conductive plate. A patch antenna element is disposed on the dielectric member.

U.S. Pat. No. 7,495,627 to Parsche entitled "Broadband Planar Dipole Antenna Structure And Associated Methods" describes a planar dipole-circular microstrip patch antenna with increased instantaneous gain bandwidth by polynomial tuning. Yet, other antenna types may be required for other needs, e.g. for horizontal rather than vertical polarization, or isotropic rather than omnidirectional radiation.

There is a need for a planar antenna that may be flexible and/or scalable as to frequency and provide adequate gain. Such an antenna may be desirable for use in patient wearable monitoring devices, for example, to provide telemetry of medical and vital information. There is also a need for an antenna having a radiation pattern sufficiently isotropic to avoid the need for product orientation, e.g. to avoid the need for antenna aiming as may be useful for radiolocation tags or tumbling satellites.

SUMMARY OF THE INVENTION

In view of the foregoing background, it is therefore an object of the present invention to provide a planar antenna device with stable frequency and sufficient gain that may be worn adjacent a body. It is yet another objective to provide a sufficiently isotropic antenna for unoriented communications devices.

These and other objects, features, and advantages in accordance with the present invention are provided by an antenna device including an electrical conductor extending on a substrate and having at least one gap therein, and with an outer ring portion to define a radiating antenna element, and at least one inner ring portion to define a feed coupler and connected in series with the outer ring portion and extending within the outer ring portion. A coupling feed element is adjacent the at least one inner ring portion, and a feed structure is connected to the coupling feed element to feed the outer ring portion.

The outer ring portion may have a circular shape with a first diameter, and wherein the at least one inner ring portion may have a circular shape with a second diameter less than the first diameter. The second diameter may be less than one third of the first diameter. Also, the first diameter may be less than a third of an operating wavelength of the antenna device.

The at least one gap and the feed coupler are preferably diametrically opposed. A plurality of inner ring portions may be provided with the coupling feed element being adjacent a selected one of the plurality of inner ring portions. The plurality of inner ring portions may have a common size and be symmetrically spaced within the outer ring portion. The substrate may be a dielectric material and may further include an adhesive layer on a side thereof opposite the electrical conductor. The coupling feed element may be a magnetic coupler ring. The feed structure may be a printed feed line, a twisted pair feed line or a coaxial feed line.

An aspect of the invention is directed to an electronic sensor including a flexible substrate, sensor circuitry on the flexible substrate, a battery coupled to the sensor circuitry and an antenna coupled to the sensor circuitry. The antenna device includes an electrical conductor extending on the substrate and having at least one gap therein. The electrical conductor includes an outer ring portion to define a radiating antenna element, and at least one inner ring portion to define a feed coupler and connected in series with the outer ring portion and extending within the outer ring portion. A coupling feed element is adjacent the at least one inner ring portion, and a feed structure is coupled between the sensor circuitry and the coupling feed element to feed the outer ring portion.

A method aspect is directed to making a wireless transmission device including providing an electrical conductor extending on a substrate and having at least one gap therein with an outer ring portion to define a radiating antenna element, and at least one inner ring portion to define a feed coupler and connected in series with the outer ring portion and extending within the outer ring portion. The method includes positioning a coupling feed element adjacent the at least one inner ring portion, and connecting a feed structure to the coupling feed element to feed the outer ring portion.

The outer ring portion may be formed to have a circular shape with a first diameter, and the at least one inner ring portion may be formed to have a circular shape with a second diameter less than the first diameter. The at least one gap and the feed coupler may be formed to be diametrically opposed. Also, forming the electrical conductor may include forming a plurality of inner ring portions, with the coupling feed element being positioned adjacent a selected one of the plurality of inner ring portions.

The antenna device of the present embodiments is scalable to any size and frequency. The antenna may be used in many applications, such as one that needs a low cost flexible planar antenna, e.g. in body wearable patient monitoring devices. The antenna device may be sufficiently isotropic to avoid the need for antenna aiming or orientation when used off the human body.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
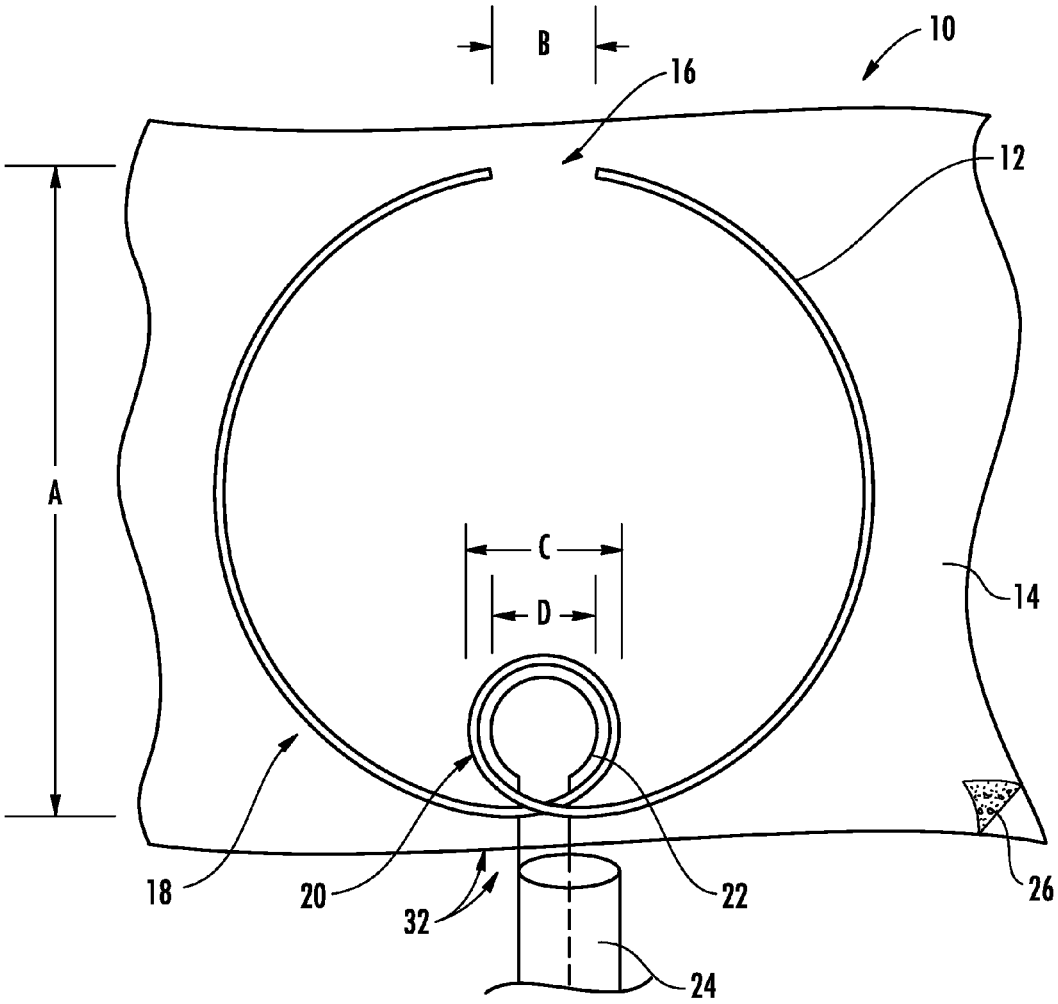
FIG. 1 is a schematic diagram of an antenna device according to an embodiment of the present invention.

Referring initially to FIG. 1, a planar antenna device 10 with stable frequency and sufficient gain will be described. Such an antenna device may be used in association with an electronic device or sensor that is worn adjacent a human body, for example. The planar antenna device 10 may be, but is not necessarily, flexible. The antenna device 10 includes an electrical conductor 12 that may reside on a substrate 14 and having at least one gap 16 therein. The substrate 14 is preferably a dielectric material and is flexible. The gap 16 may operate as a tuning feature of the antenna device 10. Such a gap 16 may rotate current distribution within the electrical conductor for matching enhancement. A variable capacitor (not shown) may optionally be connected across gap 16 for tuning.

The electrical conductor 12 includes an outer ring portion 18 to define a radiating antenna element, and at least one inner ring portion 20 to define a feed coupler connected in series with the outer ring portion 18 and extending within the outer ring portion. The inner ring portion 20 may be thought of as a loop in series with the outer ring portion 18 but it should be noted that there are preferably no electrical connections at any of the crossing points 32 of the electrical conductor 12. A coupling feed element 22 is adjacent the inner ring portion 20, and a transmission line 24 is connected to the coupling feed element 22 to feed the outer ring portion 18 via inductive or magnetic coupling through the inner ring portion 20. As such, the coupling feed element 22 may be a magnetic coupler ring. Coupling feed element 22 makes no conductive connection to inner ring portion 20 or outer ring portion 18 at any of the conductor crossing points 32.

The planar antenna device 10 may be realized in many ways, for example with thin insulated wire or with a printed wiring board (PWB). When the conductor 12 is an insulated wire, the inner ring portion may be formed as a loop, bight, or as a loose overhand knot (not shown). In PWB embodiments, vias may cross over the conductors of inner ring portion 20 with outer ring portion 18, as will be familiar to those in the art.

As illustrated, the outer ring portion 18 may have a circular shape with a first diameter A, for example, about 0.124λ or less than a third of the operating wavelength λ of the antenna device 10. The gap 16 may have a length B of about 0.0044λ, and the inner ring portion 20 may have a circular shape with a second diameter C, for example 0.022λ, which is less than the first diameter A. For example, the second diameter C may be less than one third of the first diameter A. Also, the gap 16 and the feed coupler inner ring portion 20 are preferably diametrically opposed. Coupling feed element 22 may have a diameter D, for example of about 0.022λ. Thus coupling feed element 22 may be the same diameter as or slightly smaller than inner ring portion 20.

The substrate 14 or dielectric material may further include an adhesive layer 26 on a side thereof opposite the electrical conductor 12. The feed structure 24 may be a printed feed line, a twisted pair feed line or a coaxial feed line, or any other suitable feed structure as would be appreciated by those skilled in the art.

A performance summary for a physical prototype of the single inner ring portion embodiment illustrated in FIG. 1 is included in the table below.

Performance Summary Of A Physical Prototype of FIG. 1 Embodiment Of The Present Invention

| Parameter | Specification | Basis |
|---|---|---|
| Antenna Type | Inductively Coupled Loop, Epicycloid Geometry | Curling electric currents |
| Number Of Internal Rings 20 (Number Of Cyclic Petals) | One (1) | Specified |
| Prototype Antenna Construction | Thin Insulated Wire (PWB Suitable) | Specified |
| Resonant Frequency | 371.19 MHz | Measured |
| Diameter A (Overall Size) | 0.124 Wavelengths (0.100 meters) | Measured |
| Gap B width | 0.0044 Wavelengths (0.0036 meters) | Measured |
| Diameter C | 0.022 Wavelengths (0.0177 meters) | Measured |
| Diameter D | 0.022 Wavelengths (0.0177 meters) | Measured |
| Electrical Conductor 12 | Thin Insulated Copper Wire, #22 AWG, ($0.8 \times 10^{-3}$ Wavelengths Diameter) | Measured |
| Antenna Thickness | Substantially Planar | Specified |

-continued

Performance Summary Of A Physical Prototype of FIG. 1 Embodiment Of The Present Invention

| Parameter | Specification | Basis |
|---|---|---|
| Directivity | +1.7 dBi | Calculated, Free Space |
| Realized Gain | +1 dBi | Measured, Free Space |
| Realized Gain | −15.9 dBi | Calculated, On Human Body |
| Polarization | Substantially Linear At All Look Angles | Measured |
| Polarization Sense | Horizontal When Antenna Device 10 Is Oriented Horizontally | Measured |
| Driving Point Impedance | 55 + j0.2 Ohms | Measured |
| VSWR | 1.1 to 1 in 50 Ohm System | Measured, Free Space |
| Frequency Response Shape | Quadratic | Measured |
| 2:1 VSWR Bandwidth | 3.3% (12.1 MHz) | Measured, Free Space |
| 3 dB Gain Bandwidth | 5.17% (19.2 MHz) | Calculated, Free Space |
| Radiation Pattern Shape | Spherical to within +−3.0 dB | Simulated, Free Space |
| Radiation Pattern Shape | Approximately Cardoid | Simulated, On Human Body |
| Near Fields | Radial Component Is Magnetic | Verified With Coupler |
| Tunable | Yes | Verified Variable Capacitor |

As background, Chu's Limit for single tuned 3 dB gain bandwidth ($1/kr^3$) is 11.7% for an antenna enclosed in a sphere of 0.124 wavelengths diameter. Thus, the present invention 10 may operate near 40% of Chu's Single Tuned Gain Bandwidth Limit ("Physical Limitations of Omnidirectional Antennas", L. J. Chu, Journal Of Applied Physics, Volume 19, December 1948, pp 1163-1175). Antennas according to Chu's Limit may of course be unknown and the present invention may offer advantages of sufficiently isotropic radiation, ease of manufacture, integral balun, single control tuning, etc. Thin straight ½ wave dipoles may operate near 5% of Chu's single tuned bandwidth limit.

Figure 4A:
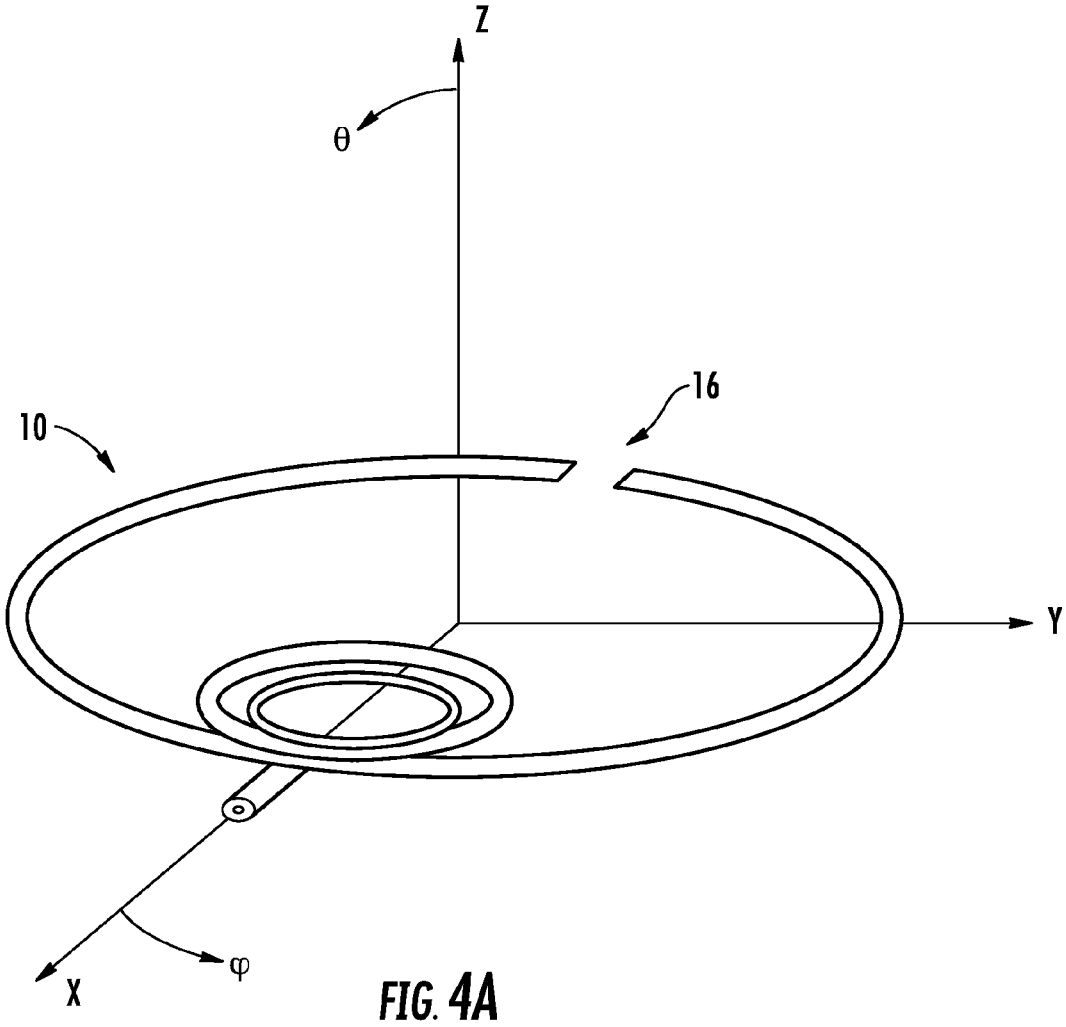
FIGS. 4A-4D are graphs illustrating the free space radiation pattern coordinate system, and respective pattern cuts in the XY, YZ and XZ planes for total fields realized gain in dBi. The FIGS. 4A-4D graphs are for the antenna device of FIG. 1.
Figure 4B:
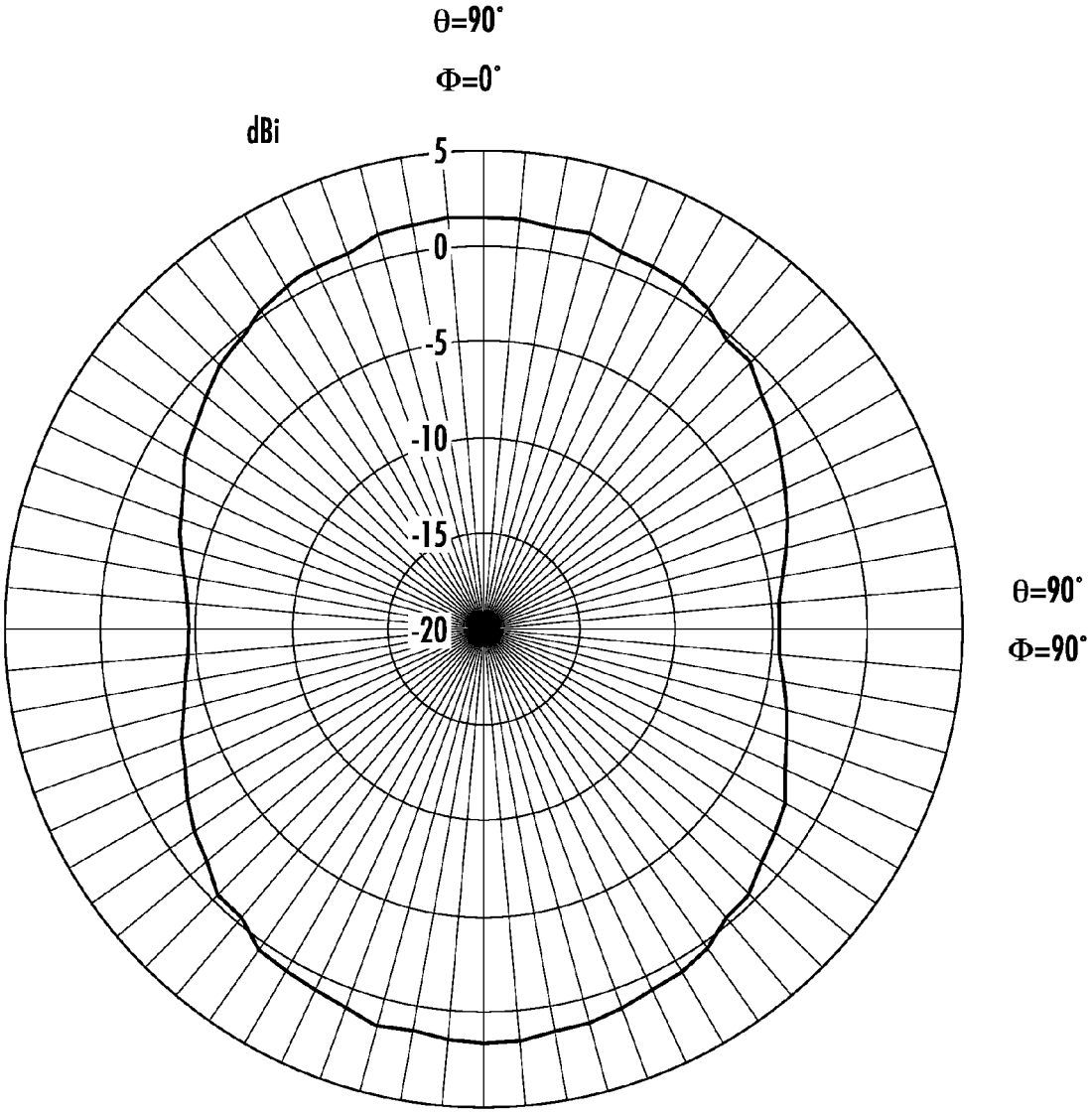
Figure 4C:
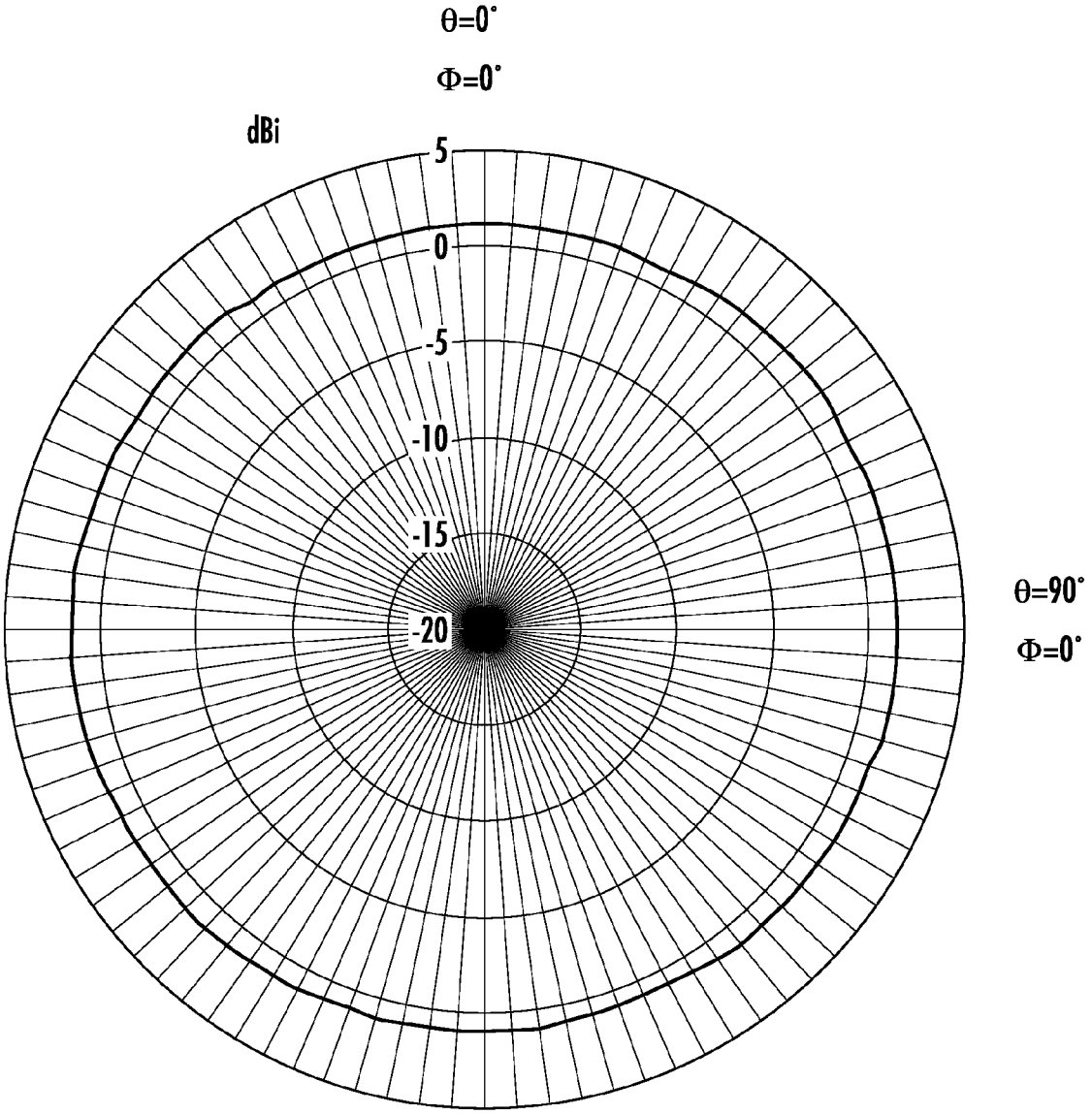
Figure 4D:
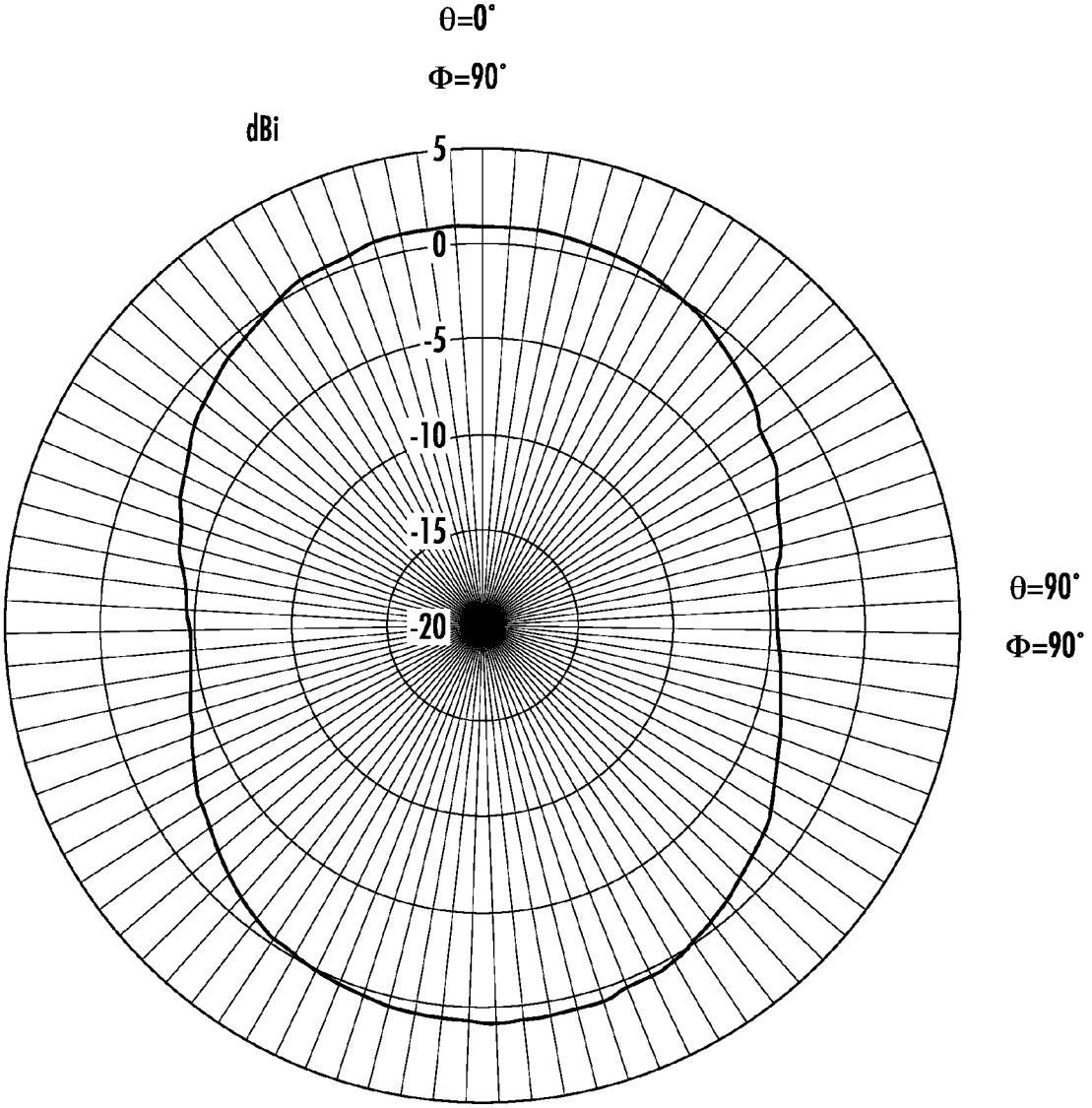

FIGS. 4A-4D are graphs illustrating the present invention in a free space radiation pattern coordinate system (FIG. 4A) and the respective principal plane radiation pattern cuts in the XY plane (FIG. 4B), YZ plane (FIG. 4C), and ZX Plane (FIG. 4D). The plotted quantity is total fields realized gain in units of dBi or decibels with respect to an isotropic radiator as described in IEEE standard 145-1993, which is incorporated herein as a reference. Realized gain as used here includes mismatch loss and material losses. The radiation pattern is advantageously isotropic (spherically shaped) to within +−3.0 dBi. The polarization is substantially linear and is horizontal when the antenna structure is in the horizontal plane. The FIGS. 4B-4D radiation patterns were obtained with a method of moments analysis code taking into account conductor resistance and matching conditions.

If the present invention is used in conjunction with a circularly polarized antenna (at the other end of the communications link), the present invention will incur only shallow fades when randomly oriented. This is because the polarization mismatch loss is nearly constant a 3 dB (circular on linear) and as mentioned previously the present invention radiation pattern is isotropic to within +/−3 dB. Thus, the present invention may be useful for when the antenna cannot be aimed or oriented such as for pagers, radiolocation devices or tumbling satellites. The use of a circularly polarized antenna in conjunction with the present invention is specifically identified as a method herein.

Figure 5:
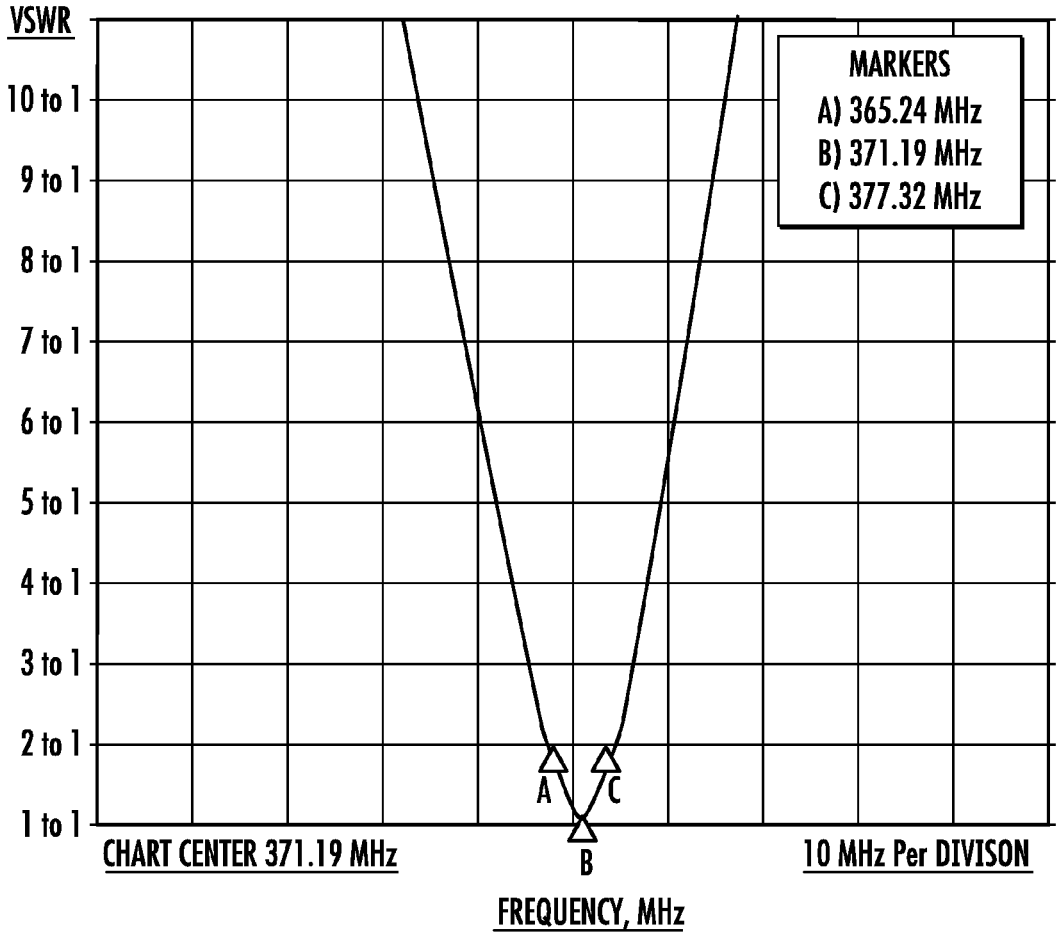
FIG. 5 is a graph of the measured VSWR response of the FIG. 1 embodiment of the present invention.

FIG. 5 depicts the measured voltage standing wave ratio (VSWR) response of the table 1 prototype of the FIG. 1 embodiment of the present invention. The measured 2 to 1 VSWR bandwidth was 3.3%, which may be useful for transmission purposes. 6 to 1 VSWR operation may be relevant for reception as 6 to 1 VSWR frequencies may correspond with antenna 3 dB gain bandwidth frequencies in small antennas.

A theory of operation for the antenna 10 of FIG. 1 will now be described. Although not so limited, the geometry of planar antenna device 12 embodiment is preferentially a cyclic mathematical curve known as the Limacon Of Pascal having $r=0.5+\cos\theta$. The Limacon Of Pascal is a particular case of epitrochoid curve the equations of which may be obtained from: "CRC Standard Mathmatical Tables, 25$^{th}$ edition, copyright 1978, page 308, case (1) a>b. This document is published by The Chemical Rubber Company and it is incorporated herein as a reference.

Continuing the theory of operation and referring to FIG. 1, the outer ring portion 18 is a circular radiating element curling a radio frequency (RF) current, e.g. a loop antenna. The current distribution along the wire is substantially sinusoidal, at minima at gap 16 and at maxima in inner ring portion 20. The far field radiation pattern may be related to the Fourier transform of the current distribution on outer ring portion 18 alone, as the radiation resistance $R_r$ of the inner ring portion 20 may be about 2 to 4 milliohms and the radiation resistance of the (larger) outer ring portion 18 about 3 to 6 ohms. The radiation resistance values are approximate and dependant on conductor diameter and gap width, however and in general: ($R_r$ outer ring)>>($R_r$ inner ring). While primarily configured for coupling purposes in the FIG. 1 embodiment, inner ring portion 20 provides some inductive loading to outer ring portion 18; about 15 nanohenries in the 371 MHz prototype for a frequency reduction of 30 percent, so the natural resonance of outer ring portion 18 would be about 30% higher without inner ring portion 20 in series. Note that the combined radiation resistance plus conductor resistance of outer ring portion 18 and inner ring portion 20 may be substantially less than the 50 ohms as is frequently sought in coaxial feed practice, so driving with a discontinuity may not suffice.

Continuing the theory of operation and referring to FIG. 1, a coupling feed element 22 is used to drive the radiating portions of the antenna structure from transmission line 24, and the coupling feed element 22 refers the antenna radiation resistance plus loss resistance to 50 ohms or to other resistances values as desired. Inner ring portion 20 and coupling feed element 22 are akin to transformer windings of one single turn each and may also comprise one half of a link coupler. The impedance transformation ratio is therefore set by loose or tight coupling and in the FIG. 1/Table 1 prototype an impedance transformation ratio of about a 10 to 1 was realized in step down (5 ohm antenna to 50 ohm coax).

The design equations for inductively tuned and link coupled circuits are described in "Radio Engineers Handbook", Fredrick E. Terman, McGraw-Hill Book Company, 1943, pp 153-162 and this document is cited as a reference herein. As background, familiar transformer design practice may be to achieve impedance transformation by an unequal turns ratio $(N_1/N_2)\neq 1$ between tightly coupled multiple turn windings. In the present invention, however, impedance transformation ratios are set by varying winding size rather than by using unequal winding turns. Increased spacing between inner ring portion 20 and coupling feed element 22 reduces antenna driving resistance. Vice versa, reduced spacing increases antenna drive resistance. Reducing the size of coupling feed element 22 reduces antenna driving resistance obtained. When coupling element 22 is located remotely from antenna device 10 it becomes a simple inductor and in one prototype it had complex impedance of Z=2 j80 ohms by itself, and when later positioned over inner ring portion 20 the antenna impedance became Z=55+j0.2 ohms. The Table 1 prototype operated at critical coupling with a circuit Q of about 37 based on 3 dB gain bandwidth.

Continuing the theory of operation, the resonant frequency of the present invention antenna 10 as a whole shifts upward slightly with increases in coupling, as is common for coupled circuits. This shift may be about ½ to 2 percent of the design frequency and may be compensated for in the tuning. In production, gap 16 may be made initially small and antenna 10 initially low in frequency. Antenna 10 may then be adjusted upwards and precisely by ablation at gap 16, e.g. tuning or production trimming. The present invention is of course not so limited however as to require manual frequency adjustment, and unlike microstrip patch antennas the present invention is relatively insensitive to PWB dielectric variation as a printed transmission line is not required internally.

Continuing the theory of operation of the FIG. 1 embodiment, inner ring portion 20 and coupling feed element 22 together form an isolation transformer type of balun in addition to a coupler as the stray capacitance between inner ring portion 20 and coupling feed element 22 may be inconsequential or nearly so. Balun devices may reduce or eliminate common currents on the outside of coaxial feed cables which in turn may cause coax cables to inadvertently radiate. Due to the balun effect, the present invention may have beneficial properties of conducted electromagnetic interference (EMI) rejection as well.

Figure 2:
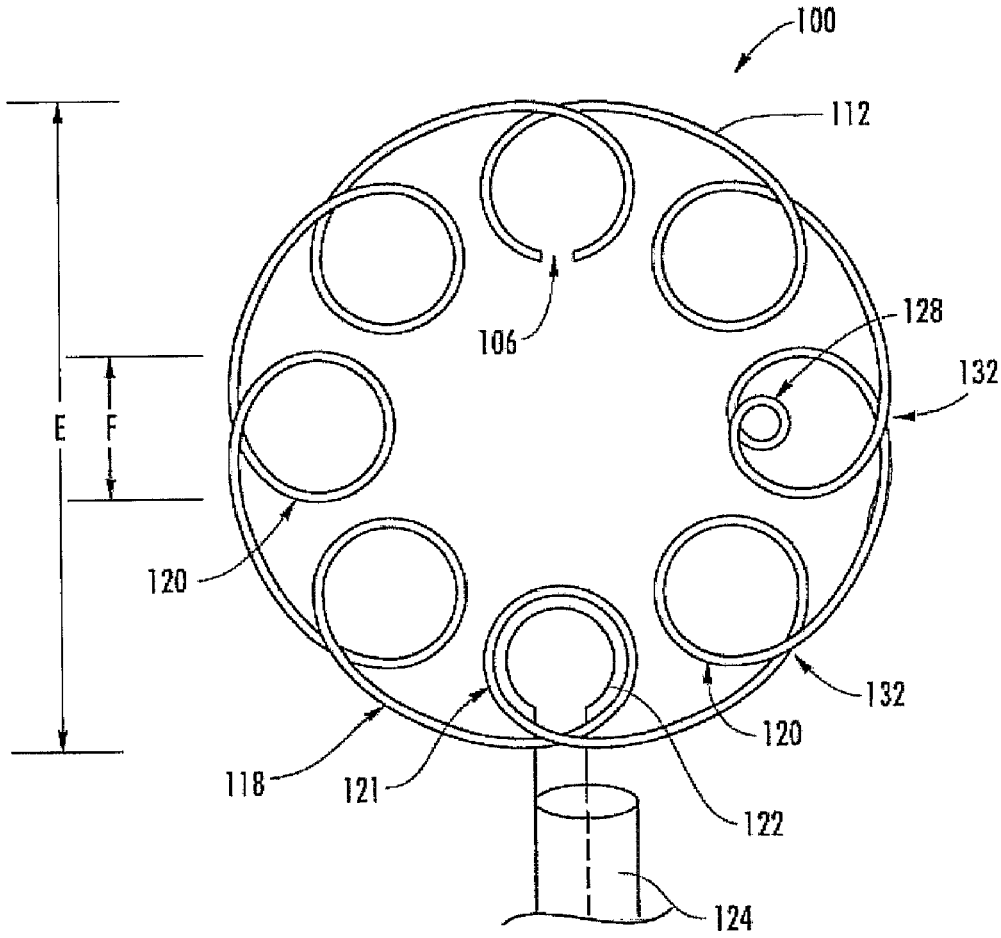
FIG. 2 is a schematic diagram of an antenna device according to another embodiment of the present invention and including multiple inner rings.

Referring to the embodiment illustrated in FIG. 2, an antenna device 100 includes an electrical conductor 112 with an outer ring portion 118 and associated gap 106 therein. The antenna device 100 includes a plurality of inner ring portions 120. The coupling feed element 122 is adjacent the feed coupler inner ring portion 121, and is connected to the feed structure 124. The plurality of inner ring portions 120 may have a common size and be symmetrically spaced within the outer ring portion 118. As illustrated, the embodiment includes eight inner ring portions 120/121, but the number thereof can independently adjust frequency and antenna size.

The inner ring portions 120/121 may be considered to be petals of a cycloid more precisely a hypotrochoid. The petals define loading inductors and/or a series fed array of radiating loop antenna elements. The feed coupler inner ring portion 121 may define a balun choke together with the coupling feed element 122.

The antenna 100 of FIG. 2 (multiple inner ring portions) is primarily directed towards electrically small size requirements and the preferred range of diameters E may be from about 0.125× to 0.0625×, although the antenna 100 may be made much smaller. Note that the cycloid geometry of the present invention traces a crossover over of conductors 132 when forming inner ring petals 120, which is advantageous to ensure constructive rather than opposing phasing between the fields of inner rings 120 and of outer ring 118.

The FIG. 2 embodiment may be realized at most combinations of size and frequency with a gain trade at the smallest sizes. As may be appreciated by those in the art, antenna gain in electrically small antennas can be impacted by conductor loss resistance, which comprises a fundamental limitation for all present day antennas using metal conductors at room temperature and having small enough size. Even slot antennas, which may have a rising radiation resistance with decreasing size are subject to the loss resistance limitations due to the onset of conductor proximity effect. In the present invention slot effect may be avoided by keeping conductor 12 widths less than about 0.20C, which means that for best gain the conductor diameter 12 should not be more than about two tenths of the diameter C of the inner coupling ring 120. Because conductor proximity effect may occur across single turns thin conductors are preferential.

The FIG. 2 embodiment may include additional inner ring portions 128 inside inner ring portion 120 for added loading effect, e.g. the present invention may form a periodic or fractal structure of much iteration. In general, for smaller and smaller diameters E of outer ring portion 118 more and more inner ring portions 120, 128 may be configured. Varying or progressively changing diameters of inner ring portions 120, 128 are anticipated and may be used to adjust multiple resonances or a harmonic series response. In prototypes there were resonances at odd harmonics.

A physical prototype of the FIG. 2 embodiment resonated at $E=0.033\lambda_{air}$ using eight (8) inner ring portions 120 of diameter $F=0.01\lambda_{air}$. The inner ring portions 120 did not overlap each other, they provided about 25 nanohenries of loading inductance each, and their combined overall loading effect was about a 4.8 to 1 frequency reduction, e.g. without any inner loading rings 120 the antenna 100 frequency of resonance would have been 583 MHz. The FIG. 2 prototype operated at 121.5 MHz having an outside diameter of 3.2 inches and a realized gain of about −10 dBi. The quality factor Q was measured at 22, which relates to bandwidth and other considerations.

Figure 3:
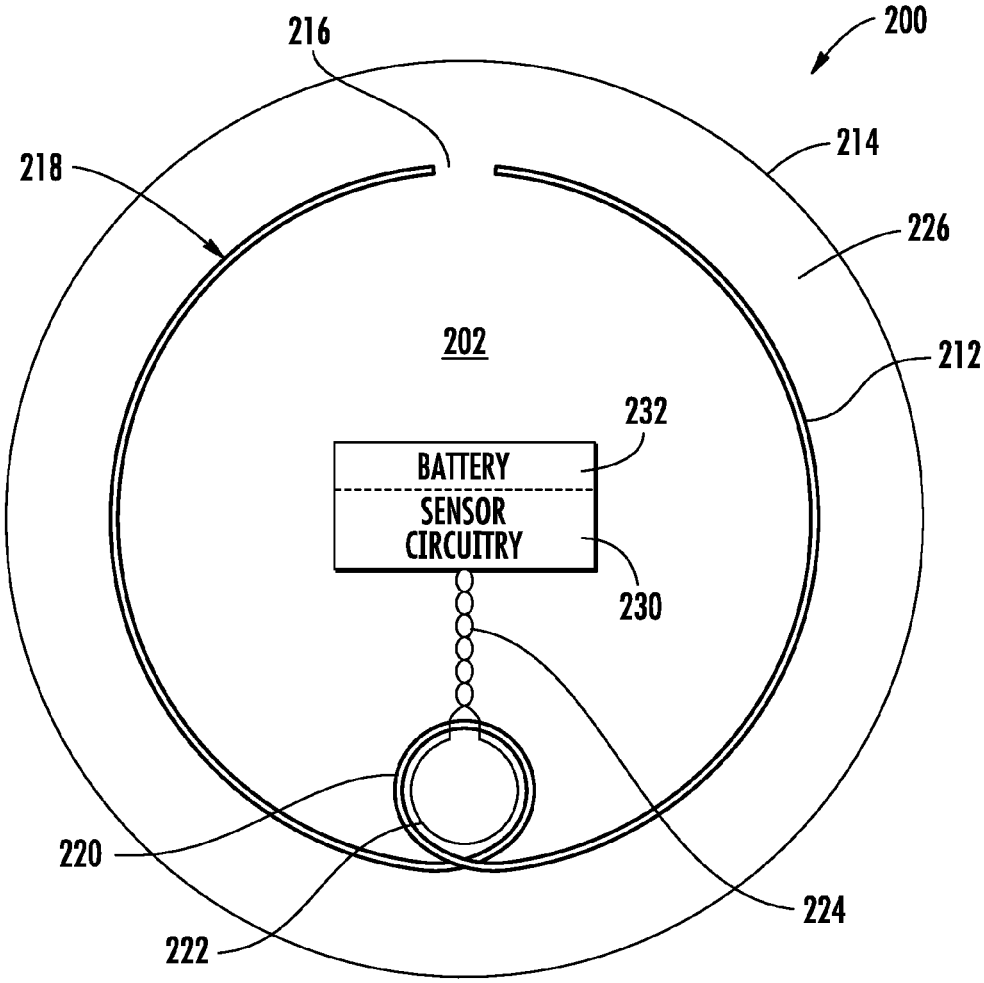
FIG. 3 is a schematic diagram of an electronic sensor including an antenna device according to another embodiment of the present invention.

With reference to FIG. 3, an electronic sensor 200 including an antenna device 202 in accordance with features of the present invention will now be described. The sensor 200 includes a flexible substrate 214, sensor circuitry 230 on the flexible substrate, a battery 232 coupled to the sensor circuitry and the antenna device 202 coupled to the sensor circuitry. The electronic sensor 200 may define a body wearable patient monitoring device, for example, for medical telemetry of human vital signs etc.

The antenna device 202 includes an electrical conductor 212 extending on the substrate 214 and having at least one gap 216 therein. The electrical conductor 212 includes an outer ring portion 218 to define a radiating antenna element, and at least one inner ring portion 220 to define a feed coupler and connected in series with the outer ring portion 218 and extending within the outer ring portion. A coupling feed element 222 is adjacent the at least one inner ring portion 220, and a feed structure 224 is coupled between the sensor circuitry 230 and the coupling feed element 222 to feed the outer ring portion 218.

The substrate 214 may be medical grade cloth or flexible bandage, for example, with adhesive 226 on the back. As such, the electronic sensor 200 could be worn on a patient's body to provide wireless telemetry of patient medical information such as vital signs etc. The sensor circuitry 230 may include various sensors for monitoring vitals such as heart rate, ECG, respiration, temperature, blood pressure, etc. which are processed with a controller/processor and transmitted via a wireless transmitter. As would be appreciated by those skilled in the art, a wireless network and data management system would be associated with the use of such electronic sensors 200.

In body worn applications the radial magnetic near fields of the present invention antenna device 202 may benefit antenna efficiency as dielectric heating of the body may be minimized, which may be important at UHF (300-3000 MHz) and higher frequencies. The antenna 202 is operable without a shield or ground plane between the antenna 202 and the patient's body, unlike typical microstrip patch antenna practice. In bandages for example, antenna device 202 may advantageously be of thin wire for patient comfort and the flexible substrate 214 breathable. For instance, at 2441 MHz the antenna device 202 may be about 0.6 inches in diameter and fabricated of #50 AWG copper magnet wire by tying, knotting or weaving.

Figure 6:
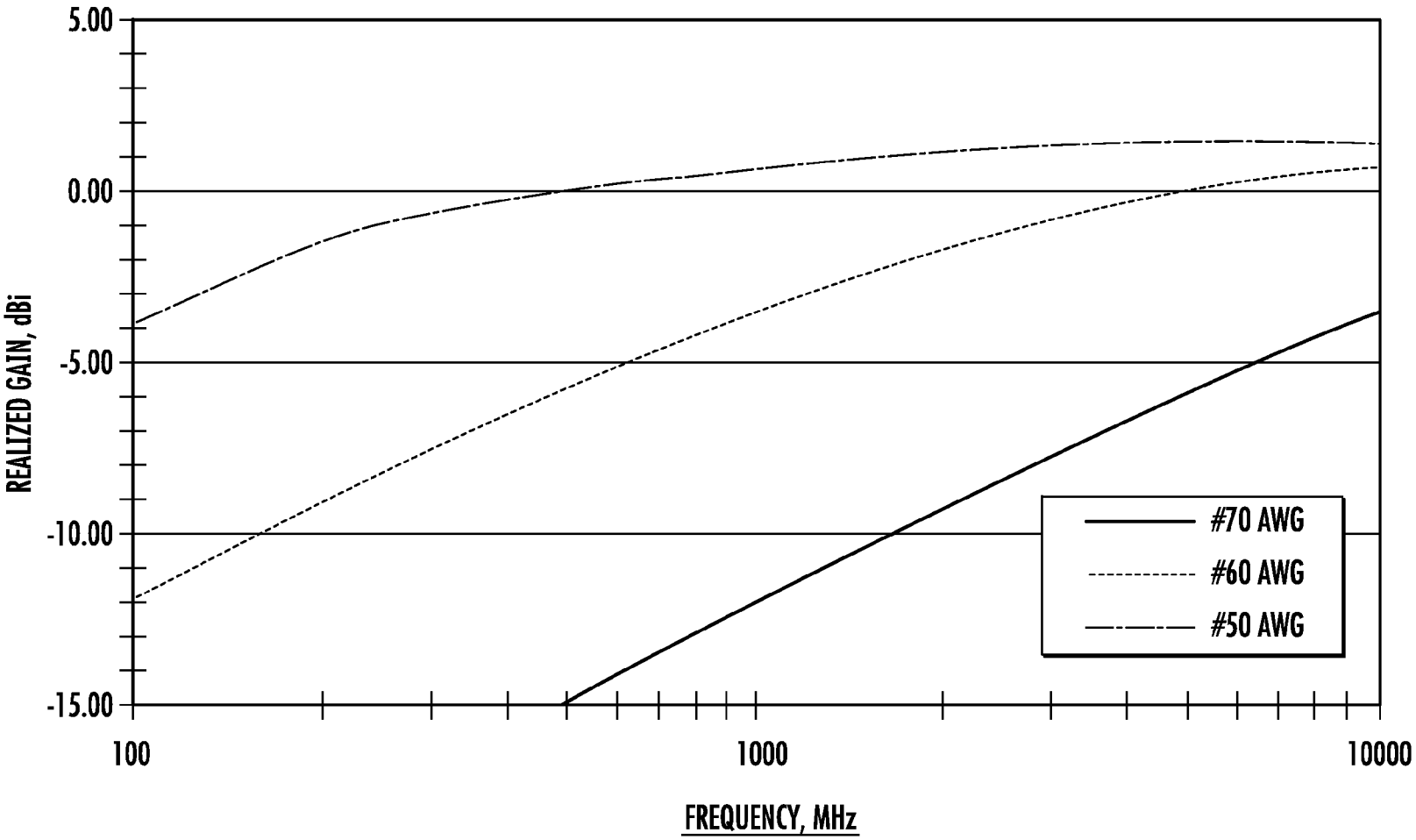
FIG. 6 is a graph of the realized gain of the FIG. 1 embodiment for various conductor sizes.

FIG. 6 depicts the free space realized gain of the FIG. 1 embodiment (which uses only one internal ring portion 20) of the present invention for various copper wire sizes and frequency. In the FIG. 6 example outer ring portion 18 and inner ring portion 20 are of the same wire gauge. As can be appreciated form FIG. 6, the present invention may provide useful radiation efficiency when made of fine conductors. As background, number 50 AWG (American Wire Gauge) wire is 25 microns in diameter and a strand of human hair may be about 100 microns in diameter. The present invention is of course not limited to wire construction, and printed wiring board, stamped metal, conductive ink, tubing or other constructions used.

Broad tunable bandwidths of 5 to 1 or more have been realized with low VSWR in the FIG. 1 embodiment of the present invention by the inclusion of a variable capacitor (not shown) across gap 16. The transformer action of inner ring portion 20 to coupling feed element 22 is broadband in nature and a variable capacitor is therefore the only tuning adjustment required, e.g. single control tuning is realized. Increasing capacitance at gap 16 reduces frequency and the tuning shift is about the square root of the capacitance change as arises from the resonance formula $F=\frac{1}{2\pi}\sqrt{LC}$, where L is the inductance of the antenna 10. Varactor diodes may provide electronic tuning and twisted wire capacitors may be formed at gap 16 as well.

With reference to FIG. 1, a method aspect is directed to making an antenna device 10 including forming an electrical conductor 12 extending on a substrate 14 and having at least one gap 16. The electrical conductor 12 includes an outer ring portion 18 to define a radiating antenna element, and at least one inner ring portion 20 to define a feed coupler and connected in series with the outer ring portion and extending within the outer ring portion. The method includes positioning a coupling feed element 22 adjacent the at least one inner ring portion 20, and connecting a feed structure 24 to the coupling feed element to feed the outer ring portion.

The outer ring portion 118 may be formed to have a circular shape with a first diameter A, and the at least one inner ring portion may be formed to have a circular shape with a second diameter C less than the first diameter. The gap 16 and the feed coupler 20 may be formed to be diametrically opposed. With additional reference to FIG. 2, forming the electrical conductor 112 may include forming a plurality of inner ring portions 120/121, with the coupling feed element 122 being positioned adjacent a selected one (121) of the plurality of inner ring portions to operate as the feed coupler.

Wire construction allows the present invention to be particularly useful as a lightweight antenna, concealment antenna, or military communications antenna. As background, many twisted wire transmission lines provide a 50 ohm characteristic impedance with sufficient twists.

The present invention is suitable for FM broadcast reception in the United States at 88-108 MHz as it is small, horizontally polarized and with omnidirectional pattern coverage.

Testing has revealed that the present invention antenna device 10 offers excellent GPS reception. That is, availability of Global Positioning System (GPS) navigation satellites was high when it was used in tracking tags comprising randomly oriented radiolocation devices. Unlike prior art circularly polarized microstrip patch antennas the present invention does not incur deep fades due to cross sense (RHCP on LHCP) polarization mismatch losses when mechanically inverted. As background, GPS satellites are low earth orbit (LEO) types actually spending little time directly overhead the ground station, rather their visible time is greatest near the horizon. The sufficiently isotropic radiation pattern of the present invention may thus be advantaged over unaimed antennas with higher gain, such as prior art microstrip patch or yagi-uda turnstile antennas.

The antenna device of the present embodiments provides a compound antenna design from an epicyclic geometric curve including an impedance matching coupler, balun, and loading inductors. The antenna size and frequency may be independently scaled and may be used in any application that needs a low cost flexible planar antenna, such as in body wearable patient monitoring devices as discussed above. Other applications include, but are not limited to, RFID, GPS, cell phones and/or any other wireless personal communications devices.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna device comprising:
a substrate; and
an electrical conductor extending on the substrate and having at least one gap therein, said electrical conductor comprising
an outer ring portion to define a radiating antenna element, and
at least one inner ring portion to define a feed coupler and connected in series with said outer ring portion and extending within the outer ring portion;
a coupling feed element adjacent the at least one inner ring portion; and
a feed structure connected to the coupling feed element to feed said outer ring portion.

2. The antenna device according to claim 1 wherein said outer ring portion has a circular shape with a first diameter, and wherein said at least one inner ring portion has a circular shape with a second diameter less than the first diameter.

3. The antenna device according to claim 2 wherein the first diameter is less than a third of an operating wavelength of the antenna device.

4. The antenna device according to claim 1 wherein the at least one gap and the feed coupler are diametrically opposed.

5. The antenna device according to claim 1 wherein the at least one inner ring portion comprises a plurality of inner ring portions; and wherein the coupling feed element is adjacent a selected one of the plurality of inner ring portions.

6. The antenna device according to claim 5 wherein the plurality of inner ring portions have a common size and are symmetrically spaced within the outer ring portion.

7. The antenna device according to claim 1 wherein said substrate comprises a dielectric material.

8. The antenna device according to claim 1 wherein further comprising an adhesive layer on a side of said substrate opposite said electrical conductor.

9. The antenna device according to claim 1 wherein said coupling feed comprises a magnetic coupler ring.

10. The antenna device according to claim 1 wherein said feed structure comprises at least one of a printed feed line, a twisted pair feed line and a coaxial feed line.

11. An electronic sensor comprising:
a flexible substrate;
sensor circuitry on the flexible substrate;
a battery coupled to the sensor circuitry; and
an antenna device coupled to the sensor circuitry and comprising
an electrical conductor extending on the substrate and having at least one gap therein, said electrical conductor comprising an outer ring portion to define a radiating antenna element, and at least one inner ring portion to define a feed coupler and connected in series with said outer ring portion and extending within the outer ring portion,
a coupling feed element adjacent the at least one inner ring portion, and
a feed structure coupled between the sensor circuitry and the coupling feed element to feed said outer ring portion.

12. The electronic sensor according to claim 11 wherein said outer ring portion has a circular shape with a first diameter, and wherein said at least one inner ring portion has a circular shape with a second diameter less than the first diameter.

13. The electronic sensor according to claim 11 wherein the at least one gap and the feed coupler are diametrically opposed.

14. The electronic sensor according to claim 11 wherein the at least one inner ring portion comprises a plurality of inner ring portions; and wherein the coupling feed element is adjacent a selected one of the plurality of inner ring portions.

15. The electronic sensor according to claim 14 wherein the plurality of inner ring portions have a common size and are symmetrically spaced within the outer ring portion.

16. The electronic sensor according to claim 11 wherein said flexible substrate comprises a dielectric material including an adhesive layer on a side thereof opposite said electrical conductor.

17. A method of making a wireless transmission device comprising:
providing an electrical conductor extending on a substrate and having at least one gap therein, the electrical conductor comprising
an outer ring portion to define a radiating antenna element, and
at least one inner ring portion to define a feed coupler and connected in series with the outer ring portion and extending within the outer ring portion;
positioning a coupling feed element adjacent the at least one inner ring portion; and
connecting a feed structure to the coupling feed element to feed the outer ring portion.

18. The method according to claim 17 wherein the outer ring portion is formed to have a circular shape with a first diameter, and wherein the at least one inner ring portion is formed to have a circular shape with a second diameter less than the first diameter.

19. The method according to claim 17 wherein the at least one gap and the feed coupler are formed to be diametrically opposed.

20. The method according to claim 17 wherein forming the electrical conductor includes forming a plurality of inner ring portions; and wherein the coupling feed element is positioned adjacent a selected one of the plurality of inner ring portions.

21. The method according to claim 20 wherein the plurality of inner ring portions are formed to have a common size and be symmetrically spaced within the outer ring portion.

22. The method according to claim 17 wherein the substrate is formed of a dielectric material including an adhesive layer on a side thereof opposite the electrical conductor.

* * * * *